United States Patent [19]

Glenn

[11] 4,035,101

[45] July 12, 1977

[54] GAS TURBINE NOZZLE VANE ADJUSTING MECHANISM

[75] Inventor: Robert G. Glenn, Huntingdon Valley, Pa.

[73] Assignee: Westinghouse Electric Corporation, Pittsburgh, Pa.

[21] Appl. No.: 670,520

[22] Filed: Mar. 24, 1976

[51] Int. Cl.[2] ..... F01D 17/12
[52] U.S. Cl. ..... 415/160
[58] Field of Search ..... 415/147, 149, 160, 150, 415/151

[56] References Cited

U.S. PATENT DOCUMENTS

| | | | |
|---|---|---|---|
| 2,950,084 | 8/1960 | Perry | 415/160 |
| 3,074,689 | 1/1963 | Chapman | 415/160 |
| 3,841,788 | 10/1974 | Sljusarev et al. | 415/147 |

*Primary Examiner*—Henry F. Raduazo
*Attorney, Agent, or Firm*—F. A. Winans

[57] ABSTRACT

A unison ring for adjusting the nozzle vanes in a split shaft gas turbine is mounted via a secondary ring attached to and encircling the casing. The secondary ring is mounted so as to accommodate dimensional variations in the housing due to temperature changes without altering the freely movable mounting engagement of the unison ring. The unison ring can thus be easily adjusted regardless of the variations in radial dimension between the housing and the unison ring.

6 Claims, 3 Drawing Figures

GAS TURBINE NOZZLE VANE ADJUSTING MECHANISM

BACKGROUND OF THE INVENTION

1. Field of the Invention

The invention relates to adjusting mechanism for the variable nozzle vanes of a gas turbine engine including a unison ring for uniformly varying the nozzle vanes and more particularly to mounting structure for such ring for accomodating dimensional variations in the housing due to thermal changes without effecting the free movement of the unison ring to adjust the vanes.

2. Description of the Prior Art

Unison rings mounted for circumferential movement about the exterior of a turbine housing are well known in the art as a means to couple a row of variable vanes for uniformly changing the angle of the vanes as desired. Heretofore, such unison rings were used to vary the angle of vanes adjacent the inlet to the compressor of a gas turbine engine. In this environment, the unison ring could be supported on rollers mounted directly on the exterior of the housing in that the ambient temperature and the temperature of the casing under running conditions were essentially the same. However, in that area of the casing exposed to the hot motive fluid driving the turbine rotors, the casing expands from its ambient condition, and whereas prior to expansion, the unison ring mounted in the prior art manner would be freely movable, the expansion of the housing without commensurate expansion of the ring (which is separated by a space and thus not exposed to the same temperature) would cause a binding engagement to the end that components might either become overstressed and break or, in the least, the movement of the unison ring would be extremely difficult.

SUMMARY OF THE INVENTION

The present invention provides support for a unison ring coupled to the variable nozzle vanes of a gas turbine engine. These vanes being disposed in the path of the hot motive fluid, are enclosed by a housing that expands as it becomes heated. As the unison ring is assembled when the housing is relatively cool, the support must be capable of accommodating the expansion of the housing without effecting the free circumferential movement of the unison ring necessary to adjust the vanes. Thus, a secondary or stationary ring is provided which is attached to the housing through a plurality of pivotal links. The links extend between the housing and the stationary ring in a non-radial direction such that expansion of the housing is accommodated by a slight circumferential shift in the stationary ring. The stationary ring and the pivotal links thus establish a support which does not move radially in response to radial growth of the housing. The unison ring is supported by an extension of the links for circumferential movement about the housing.

As a further consideration, the unison ring and the secondary or stationary ring are sized rather closely and generally exposed to the same heat source whether from radiation from the adjacent housing or the conductive path through the link, such that their expansion characteristics are closely analagous so that the rolling engagement initially established by the positioning of the stationary ring is maintained under operating conditions.

Further, the coupling of the vane adjustment mechanism to the unison ring provides a generally multidirectional movement to accommodate the circumferential movement of the ring and also relative radial movement between the unison ring and the vane mechanism extending through the housing.

DESCRIPTION OF THE PREFERRED EMBODIMENTS

Figure 1:
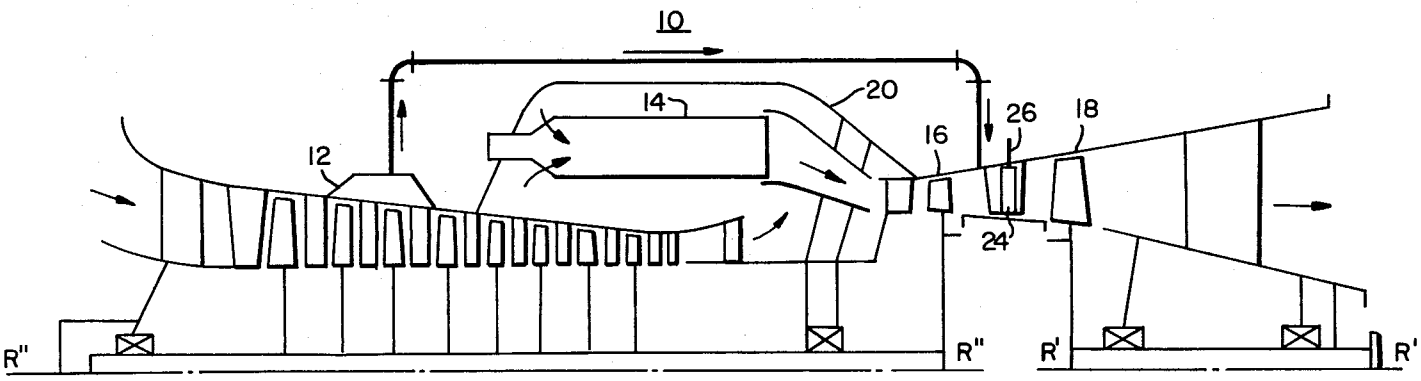
FIG. 1 is a schematic cross-sectional view of a split shaft gas turbine having variable nozzle vanes.

The present invention is directed to a mechanism for angularly positioning variable nozzle vanes disposed between the outlet of the high pressure turbine and the inlet of the low pressure turbine of a split shaft axial flow gas turbine engine. For purposes of illustration, such a gas turbine engine is schematically illustrated in FIG. 1; however, such an engine with variable nozzle vanes is more fully described in copending commonly assigned U.S. application Ser. No. 656,496, filed Feb. 20, 1976.

As seen in FIG. 1, the engine 10 comprises, in flow sequence, a compressor 12, a combustor 14, a high pressure turbine 16 and a low pressure turbine 18 with a single row of variable nozzle vanes 24 disposed between the high and low pressure turbines. The engine is enclosed by a housing 20 through which drive rods 26 for positioning the vanes extend for manipulation externally of the housing. It is important to note that the housing enclosing the row of variable vanes is exposed to the hot motive fluid driving the turbines and thus subject to dimensional variations in its radius due to thermal changes. Thus, whereas variable vanes disposed adjacent the compressor inlet are normally coupled to a unison ring which is circumferentially movable on rolling structure mounted directly on the housing, such support would not be appropriate in this area of the housing which experiences radial growth during operation of the turbine. In that the radial expansion of the housing would be greater than the radial expansion of the unison ring, (as the unison ring is in a much cooler environment) proper rolling engagement of the unison ring to the housing during assembly could become inoperative when the engine was operating because of this variation in thermal growth.

Figure 2:
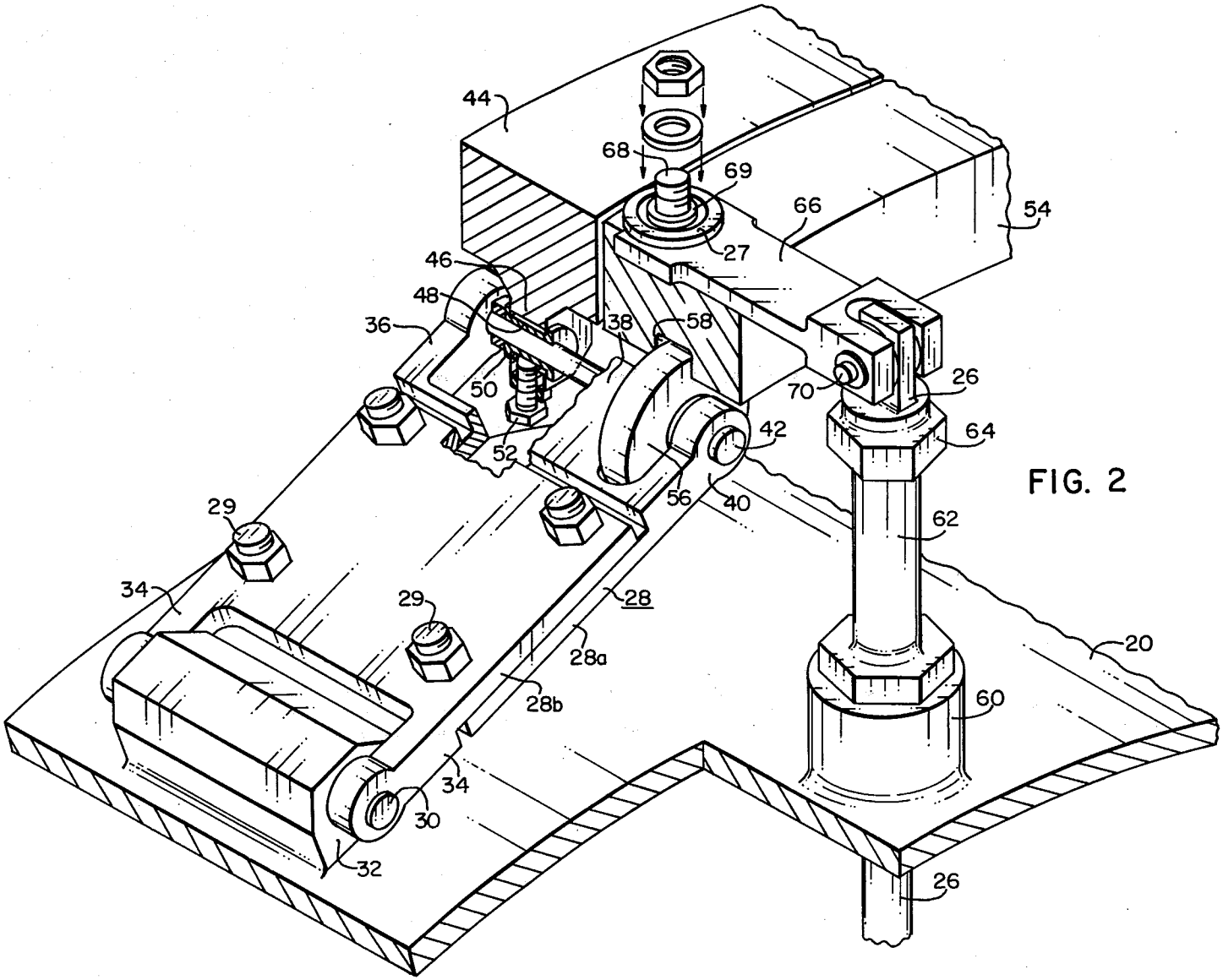
FIG. 2 is an isometric view of a portion of the housing supporting one of a plurality of link members with a section broken away and a portion of the stationary ring and unison ring according to the present invention.

Thus, reference is made to FIG. 2 to show the preferred vane adjusting mechanism and support therefore for variable vanes disposed in an elevated temperature region of the engine. As therein seen, a link member 28 is pivotally attached at one end to the housing 20 as through a pin 30 extending through a block 32 solidly attached to the housing and through opposed arms 34 of one end of the link. The opposite end of the link 28 is forked to provide three extensions 36, 38, 40 with a pin 42 commonly extending transversely therethrough.

A stationary ring 44 encircles the housing 20 and is spaced therefrom and defines a downwardly extending rib portion 46 having an aperture 48 for receipt therein of the pin 42. The aperture 48 is elongated in the radial direction and contains a bushing 50 sized so as to receive the pin 42. A set screw 52 threadably secured to the underside of the rib 46 extends upwardly into the elongated aperture 48 to radially position the bushing therein and thus in turn radially positioning pin 42.

Figure 3:
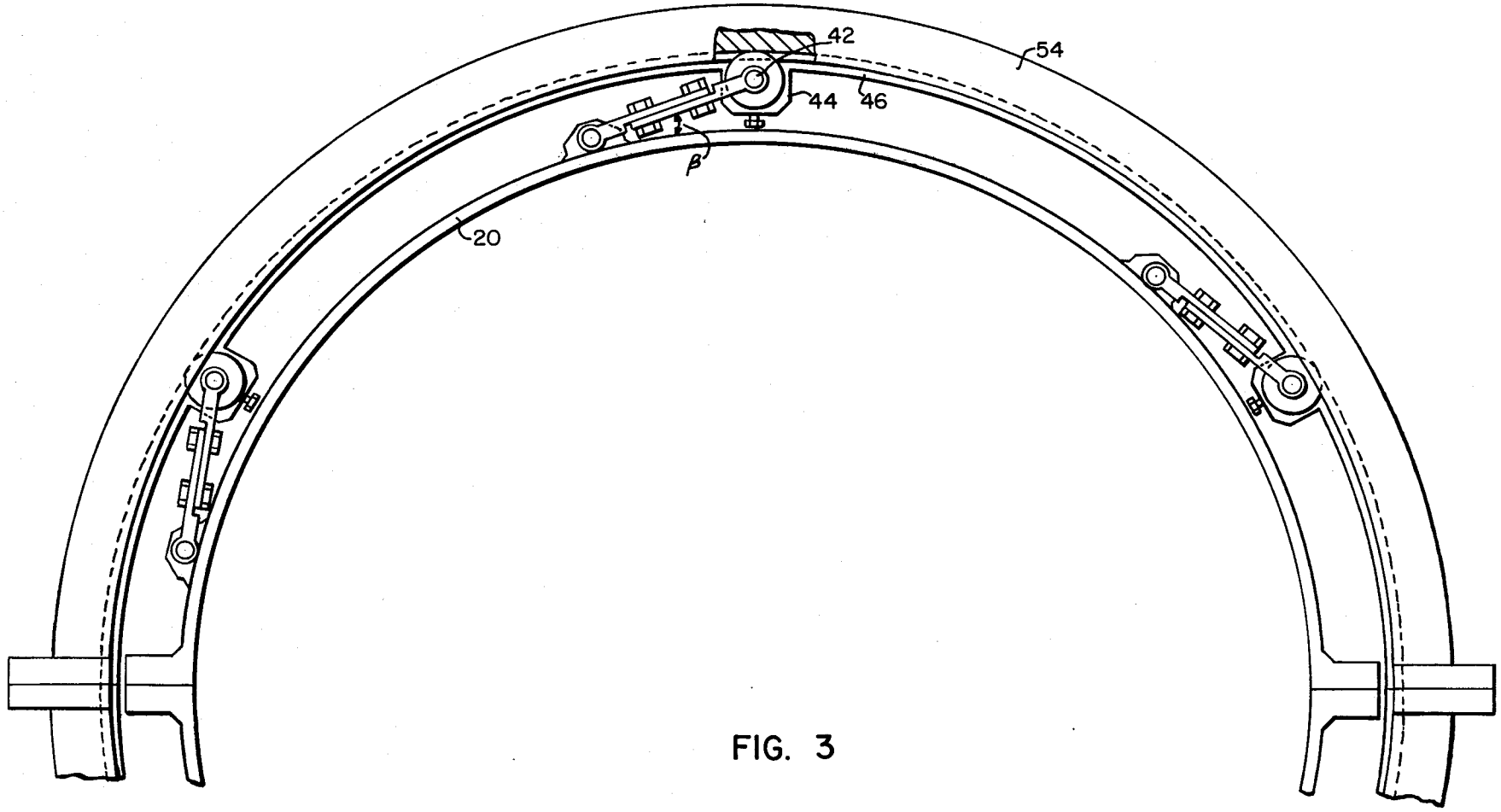
FIG. 3 is a cross-sectional elevational view of the upper half of the turbine housing and support mechanism.

With reference to FIG. 3, it is seen that a plurality of such links 28 (i.e. three links being associated with each semicylindrical portion of the housing) of equal length maintains the stationary ring 44 in a definite predetermined position concentric with the axis of the turbine. Further, it is more clearly seen in FIG. 3 that each link 28 extends between the housing 20 and the stationary ring 44 in a non-radial direction defining an acute angle $\beta$ between the link and the housing. Thus, upon outward radial expansion of the housing 20, without a commensurate radial expansion of the stationary ring which is in a much cooler environment, the radial distance between the ring and the housing decreases. This is compensated for by each pivotal link 28 assuming a decreased angular relationship ($<\beta$) with the housing, which in turn is compensated for by a slight circumferential movement of the stationary ring; however, the stationary ring and the point of pivotal connection of the link to the ring, i.e., pin 42, remain at essentially the same radial dimension and concentric with the turbine axis.

Referring again to FIG. 2, it is seen that a unison ring 54 is mounted so as to encircle the housing 20 with rolling circumferential movement with respect thereto. In the preferred embodiment, this rolling engagement is provided by a roller 56 mounted on the pin 42 defining the pivotal axis of the link 28 to the stationary ring 44 which, as described above, remains at a substantially constant radial position. The roller 56 is received in a groove 58 in the underside of the unison ring 54 for guided circumferential movement of the ring. It is to be noted that the unison ring is sized generally commensurate with the stationary ring 44 and at the same radial dimension. Also, they are both in contact with structure on the link 28. Thus, under these circumstances, both rings should have generally the same dimensional changes due to thermal variations in that conducted and radiated heat transmitted to them should be substantially the same. However, it is to be understood that such limitations are not critical, as a minimal amount of dimensional changes by the rings, because of their distance from the housing, could be otherwise accommodated. Thus, the rings could be of quite different size or the rolling engagement could be from an extension of the stationary ring, or the rings could also be disposed at distinctly different radial dimensions (although they must be concentric about the axis).

As described in the previous copending application, each variable nozzle vane 24 is rotated by a drive rod 26 extending radially outwardly through an internally threaded raised boss 60 extending from the housing and into which is threaded a hollow tube 62 having external threads for receipt at its outer end and a gland net 64 through which the drive rod 26 extends thereby maintaining a sealed relationship with the housing. A lever member 66 which is forked at both ends extends between the projecting portion of the drive rod 26 and an upwardly extending threaded stud 68 attached to the unison ring 54. The attachment of the lever member to the rod is through a pin 70 to provide relative rotational movement in a plane parallel to the radial movement of the rod whereas the attachment of the lever 66 to the threaded stud 68 through engagement of a spherical segment 69 on the stud by a sheave 72 encircling the segment and engaged by the forked lever, provides relative circumferential movement of the ring with respect to the drive rod 26 and accommodates relative radial movement therebetween without interference. Through this arrangement it is seen that with all vanes connected to the unison ring 54 in this manner circumferential movement of the unison ring will uniformly vary the angular disposition of the nozzle vanes. Further, as the housing expands, the slight circumferential movement of the stationary ring 44 may, through friction, slightly circumferentially move the unison ring. However, such movement can be tolerated and manually compensated for by merely moving the unison ring back to the initial position if such is the angular relationship desired of the variable vanes.

For purposes of assembly, the link members 28 are seen to comprise two separate halves. One half **28*a* is mounted to the stationary ring 44 through the pin 42 in spring 48 whereas the other half 28*b* is mounted to the housing. Thus, the stationary ring can be disposed concentrically about the housing with the two halves then secured together as through bolts and nuts 29** with the mating bolt holes sized so as to accommodate slight variations from the true position imposed by design and manufacturing tolerances.

Thus, with this arrangement, proper assembly of the unison ring to the housing during assembly of the gas turbine is retained even when the housing expands during operation as the unison ring is in rolling contact with a member supported by a stationary ring which in turn is supported at a relatively non-changing radial dimension. Also, the forked sliding connection between the lever 66 attaching the drive rod 26 to the unison ring 54 permits a single lever member to mimimize the assembly tolerance that must be maintained.

I claim:

1. A mechanism for adjusting variable nozzle vanes of a gas turbine engine wherein said mechanism includes:

a stationary ring member encircling the housing of said engine in spaced concentric relation thereto and generally adjacent vane turning structure extending exteriorly of said housing;

means for mounting said stationary ring member to said housing at a substantially constant radial position regardless of dimensional changes in said housing due to temperature variations thereof comprising:

a circumferentially movable ring member encircling the housing in spaced relation thereto and adjacent said stationary ring member;

support structure attached to said stationary ring member and engaging said movable ring member for guided circumferential movement of said movable ring member; and, lever means extending between said movable ring member and said external vane turning structure for transferring circumferential movement of said movable ring member to angular movement of said nozzle vanes;

a plurality of link members extending from said housing in a non-radial direction and pivotally attached at one end to said housing and pivotally attached at the opposite end to said stationary ring member whereby radial dimensional changes of said housing are compensated for by pivotal movement of said link members.

2. The adjusting mechanism of claim 1 wherein said pivotal attachment of said opposite end of said link member to said stationary ring member comprises:

a hinge pin connected to one of the said members and received in a complementary opening in the other of said members for relative rotational movement and wherein said opening is elongated in the radial direction; and means for adjusting the relative radial position of said pin within said opening to position said stationary ring concentric about the axis of said engine.

3. The adjusting mechanism according to claim 2 wherein said support structure attached to said stationary ring comprises:

a wheel member; and means extending from said hinge pin for rotationally supporting said wheel member; and wherein, said wheel member is disposed in supporting contact adjacent said circumferentially movable ring member and received within a circumferential channel therein for guided rolling movement therebetween.

4. A mechanism for adjusting variable nozzle vanes of a gas turbine engine wherein said mechanism includes:

a movable ring member encircling the housing of the engine in spaced relationship thereto and generally adjacent vane turning structure extending exteriorly of said housing;

means attached to said housing for supporting said movable ring and permitting circumferential movement of said ring regardless of dimensional changes of said housing from temperature variations, said last-named means comprising:

an assembly including:

a stationary ring member encircling the housing generally adjacent said movable ring member and concentric therewith;

a plurality of link members extending in a nonradial direction and means for pivotally attaching one end of said link member to said housing and a second means for pivotally attaching the opposite end of said link member to said stationary ring member to support said stationary ring member and said second pivotal attaching means at a constant radial position; and, means, attached to structure of said assembly having said constant radial position, for supporting said movable ring member for guided circumferential movement; and wherein, said adjusting mechanism further includes a lever means extending between said movable ring member and said external structure of said vanes for transmitting said circumferential movement of said movable ring member to angular movement of said variable vanes.

5. An adjusting mechanism according to claim 4 wherein said level member includes:

structure at one end cooperating with said vane turning structure for a hinged connection therebetween; and, an open slotted opposite end for slidably engaging radially outwardly projecting structure of said movable ring member.

6. An adjusting mechanism according to claim 4 wherein said second means for pivotally attaching the opposite end of said link member to said stationary ring member comprises:

a hinge pin supported by one of said members and received in a complementary opening in the other of said members; and wherein said means for supporting said movable ring member comprises:

a wheel member; and means extending from said hinge pin for rotationally supporting said wheel member subadjacent said circumferentially movable ring member and within a circumferential channel therein for guided movement therebetween.

* * * * *